US007377395B1

(12) United States Patent
Mak

(10) Patent No.: US 7,377,395 B1
(45) Date of Patent: May 27, 2008

(54) SANITARY PACK FOR RESTROOMS

(76) Inventor: Kevin Mak, 17 Mott St., Apartment R5, New York, NY (US) 10013

( * ) Notice: Subject to any disclaimer, the term of this patent is extended or adjusted under 35 U.S.C. 154(b) by 321 days.

(21) Appl. No.: 11/206,518

(22) Filed: Aug. 19, 2005

(51) Int. Cl.
*B65D 69/00* (2006.01)

(52) U.S. Cl. ..... 206/581; 206/473; 206/494; 206/823

(58) Field of Classification Search ..... 206/37, 206/38, 233, 472, 473, 494, 581, 823; 4/245.1, 4/245.8; 132/312, 314, 315, 286
See application file for complete search history.

(56) References Cited

U.S. PATENT DOCUMENTS 4,739,809 A * 4/1988 Adams ..... 206/823
4,881,278 A * 11/1989 Farah ..... 4/245.1
5,251,746 A * 10/1993 Gresh et al. ..... 206/472
5,579,916 A * 12/1996 Manko ..... 206/581
5,947,275 A * 9/1999 Hess ..... 206/494
6,913,146 B2 * 7/2005 Bechyne et al. ..... 206/494

* cited by examiner

*Primary Examiner*—Luan K Bui
(74) *Attorney, Agent, or Firm*—Robert S. Salzman

(57) ABSTRACT

An article of manufacture comprising a packet for carrying and dispensing of sanitary articles needed in toilet hygiene. Restroom facilities do not always offer toilet seat covers for use to the patrons of the establishment. Sometimes the supplies at various toilet stations are depleted. The article of this invention comprises a sealed packet of useful toiletry materials that easily fits in the pocket or purse of a traveler, and which opens to supply a toilet seat cover, as well as tissues, towels, temporary underwear, or undergarment liners.

3 Claims, 1 Drawing Sheet

SANITARY PACK FOR RESTROOMS

FIELD OF THE INVENTION

The invention pertains to traveling accessories for comfort stations and restrooms, and more particularly to an easily carried sanitary pack that comprises toilet seat covers, napkins, and/or toilet paper for use in unsanitary toilet facility conditions.

BACKGROUND OF THE INVENTION

It is one of the most disappointing discomforts of modern life, to enter a filthy or unsanitary toilet facility away from home. Entering such restrooms or relief stations can be a trying experience, even when the facilities are relatively clean or adequate for providing the relief sought.

It is known that bacteria can be transmitted to humans by contact with unsanitary toilet seats. Many people try to avoid directly sitting upon a toilet seat for fear of acquiring disease. Some people try crouching above a toilet bowl, when they relieve themselves. This is both cumbersome and tiring. Still others use inordinate amounts of toilet paper in trying to wipe-down, or coat the toilet seat prior to use.

There are some comfort stations and restrooms that will supply a toilet seat cover. Even some states, such as California, are proposing laws to make it mandatory for restroom facilities to offer toilet seat covers.

Even with growing toilet seat cover availability, there is always a good chance that such amenities may be absent, or where available, may be fully consumed or exhausted. This inadequacy also applies to other restroom supplies, such as: towels, tissues, and toilet paper.

In most cases, therefore, it is a hit-or-miss affair to find the proper sanitation and amenities in restroom facilities, when one is away from home.

The present invention comprises a packet of sanitary materials for use while traveling. The packet of materials is enclosed in a cellophane bag, which is easily torn or ripped away in order to expose the packet of materials inside. The packet is shaped like a book having sleeve pockets on each inside leaf. Sanitary supplies are housed inside each sleeve pocket. On one side, is a supply of one or two, folded covers for toilet seats. On the other side, there is housed a supply of folded toilet paper, or a number of tissues.

In addition, a separate packet can contain a pair of folded paper panties, and/or paper briefs, for those occasions when an individual has an accident in his underwear. The paper panties can comprise linen-type paper, or light fabric materials, such as: silk, rayon, polyester, or nylon.

It is also contemplated that a packet of this invention can have one leaf pocket containing folded toilet seat covers, and the adjacent pocket containing a folded brief or panty, or a brief or panty liner. The liner is designed to fit within a brief or panty to prevent soiling of the brief or panty. The liner can be easily discarded after its use.

SUMMARY OF THE INVENTION

In accordance with the present invention, an article of manufacture is described in which sanitary restroom supplies can be carried upon a person away from home. Owing to the inadequate supplies provided in many restrooms, the invention provides a packet of sanitary restroom materials that can be carried upon a person for emergency use. The article of manufacture is in the form of a small, folded packet of restroom supplies, which is easily transportable. Paramount to the materials being supplied is a pocket containing one or two folded toilet seat covers. The packet can be shaped like a small book. The book is enclosed in a sealed cellophane bag, which can be easily torn open. Unfolding the book leaves, presents adjacent sleeves or pockets containing restroom necessities. Adjacent the pocket with the folded toilet seat covers, is another pocket containing one of the following items: tissues, toilet paper, a folded woman's panty, a folded man's brief, a folded panty liner, a folded brief liner, or small, folded towels.

The inventive article is designed to easily fit in a man's shirt or jacket pocket, or within a woman's purse.

It is an object of the present invention to provide an improved packet of sanitary materials for use in toilet facilities away from home.

Another object of this invention is to provide a packet of sanitary restroom materials that can be easily carried upon a person when away from home.

It is yet a further object of the invention to provide a packet of sanitary restroom materials upon one's person, one of which is a toilet seat cover.

It is but another object of this invention to provide an article of manufacture comprising a packet of sanitary materials for use in foreign rest facilities.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, an article of manufacture is described that is useful in the carrying and dispensing of sanitary articles needed in toilet hygiene. Restroom facilities do not always offer toilet seat covers for use to the patrons of the establishment. Sometimes the supplies at various toilet stations are depleted. The article of this invention comprises a sealed packet of useful toilet materials that easily fits in the pocket of a traveler, and which opens to supply a toilet seat cover, as well as tissues, towels, or temporary underwear.

Figure 1:
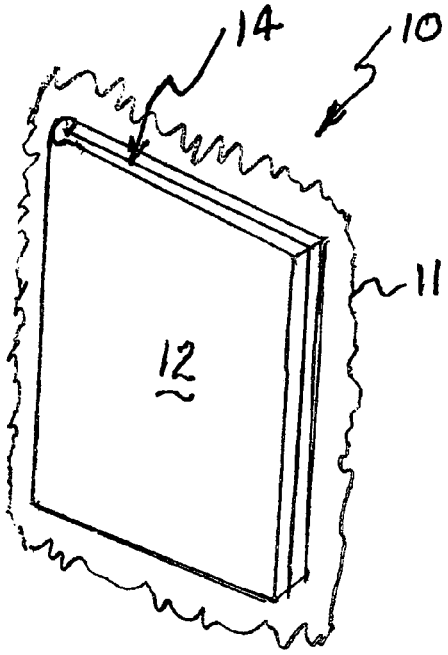
FIG. 1 illustrates a perspective view of the sealed packet of sanitary materials of this invention.

Now referring to FIG. 1, a perspective view of the sealed packet of restroom sanitary materials 10, is shown. The sealed packet 10 comprises an outer covering 11 of cellophane, or other transparent material, that is easily torn open to reveal the paper or plastic packet 12 inside, as illustrated. The packet 12 is shaped like a closed book 14, as shown.

Figure 3:
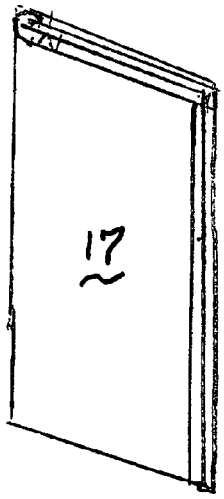
FIG. 3 shows a perspective view of one of the folded sanitary materials that fit in one of the sleeves of the packet illustrated in FIG. 2.
Figure 2:
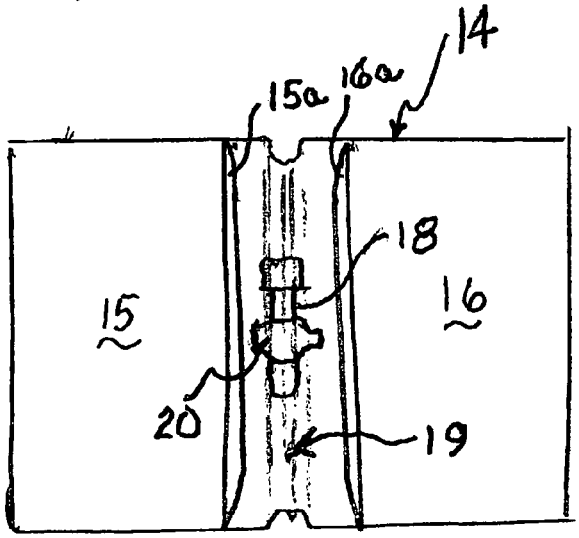
FIG. 2 depicts a front view of the opened packet of sanitary materials.

Referring to FIG. 2, a front view of the book-shaped packet 14 is illustrated in the opened state. Opening of the book-shaped packet 14 reveals a left leaf and right leaf 15 and 16, respectively. The left leaf 15 comprises an open pocket 15*a*, and the right leaf 16 comprises an open pocket 16*a*. The left pocket 15*a* comprises a folded seat cover 17, depicted in FIG. 3. The right pocket 16*a* contains one of many similar folded articles, such as: tissues, small towels, a paper panty; a paper jockey brief, or an underwear liner.

These other articles can be used where bathroom supplies are absent, or in cases of emergencies, where undergarments have been soiled or stained.

The folded articles can comprise heavy paper, generally of a linen weight, so that they provide substantial coverage and durability.

More than one packet of materials can be used or carried upon one's person, as suggested. In this regard, a full compliment of toilet accessories can be easily carried or transported by a user.

Referring again to FIG. 2, a small vial of cologne, or perfume 18 can be carried in the fold of the book-shaped packet 14, and can be slid out from a tab 20, which anchors the elongated vial 18 in place within the fold 19.

The perfume or cologne can be used to freshen up the face and hands, in the event that soap, or other cleaners are absent or harsh smelling.

Since other modifications and changes varied to fit particular operating requirements and environments will be apparent to the skilled practitioner of this art, the invention is not considered limited to the example given for purposes of disclosure, but rather is deemed to cover all changes and modifications which do not constitute departures from the true spirit and scope of the invention.

Having thus described the invention, what is desired to be protected by Letters Patent is presented in the subsequently appended claims.

What is claimed is:

1. A transportable, book-shaped, sanitary packet of toilet items for use in restroom facilities, comprising: a folded item that is easily carried in a pocket or purse, said folded item having means defining at least two internal pockets containing toiletry items, one of said at least two internal pockets containing one or two folded toilet seat covers, another of said at least two internal pockets comprising several sheets of folded toilet paper, each of said pockets comprising means defining an opening for sliding the toiletry items out of said transportable packet, a vial of perfume or cologne disposed between said internal pockets, and a protective, frangible material sealing said transportable packet of toilet items which can be torn to reveal the packet contents.

2. A transportable, sanitary packet of toiletry items for use in restroom facilities, comprising: a folded book-shaped item having means defining at least two internal pockets containing folded toiletry items, each internal pocket comprising an open flap for reaching into the internal pocket in order to extract the folded toiletry items, said transportable packet being generally of a size that easily fits within a pocket of a person or a purse, said transportable packet of toiletry items comprising in a first internal pocket one or two sheets of a folded toilet seat cover, and in a second of said at least two internal pockets there being a disposable panty or disposable undergarment, said transportable packet being sealed inside a frangible, protective material.

3. A transportable, sanitary packet of toilet items for use in restroom facilities, comprising: a folded book-shaped item having means defining internal pockets disposed upon adjacent leafs of said folded book-shaped item, said internal pockets containing toiletry items, one of said internal pockets containing one or two sheets of a folded toilet seat cover, each of said pockets comprising means defining an opening for sliding the toiletry items out of said transportable packet, a second one of said internal pockets containing folded sheets of toilet paper, or paper-like underwear, and wherein said transportable packet is sealed with a protective, frangible material that can be ripped open to reveal said sanitary packet.

* * * * *